US009562195B2

(12) United States Patent
Hagemeier et al.

(10) Patent No.: US 9,562,195 B2
(45) Date of Patent: Feb. 7, 2017

(54) METHOD AND SYSTEM FOR SEPARATING A HOT GAS FLOW THAT IS CHARGED WITH MATERIAL AND METHOD FOR PROCESSING OIL SHALE MATERIAL

(75) Inventors: Olaf Hagemeier, Beckum (DE); Reinhard Giesemann, Harsewinkel (DE); Manfred Jasper, Ennigerloh (DE)

(73) Assignee: ThyssenKrupp Industrial Solutions AG (DE)

( * ) Notice: Subject to any disclaimer, the term of this patent is extended or adjusted under 35 U.S.C. 154(b) by 603 days.

(21) Appl. No.: 13/984,140

(22) PCT Filed: Feb. 6, 2012

(86) PCT No.: PCT/EP2012/051972

§ 371 (c)(1),
(2), (4) Date: Aug. 7, 2013

(87) PCT Pub. No.: WO2012/107407

PCT Pub. Date: Aug. 16, 2012

(65) Prior Publication Data

US 2013/0313166 A1 Nov. 28, 2013

(30) Foreign Application Priority Data

Feb. 11, 2011 (DE) ..... 10 2011 000 669

(51) Int. Cl.

| | |
|---|---|
| ***C10G 1/02*** | (2006.01) |
| ***C10B 53/06*** | (2006.01) |
| ***C10B 49/16*** | (2006.01) |
| ***C10B 49/04*** | (2006.01) |
| ***B07B 7/00*** | (2006.01) |

(Continued)

(52) U.S. Cl.

CPC . *C10G 1/02* (2013.01); *B07B 7/00* (2013.01); *B07B 9/02* (2013.01); *C10B 49/04* (2013.01); *C10B 49/16* (2013.01); *C10B 53/06* (2013.01); *C10G 1/045* (2013.01)

(58) Field of Classification Search

CPC ..... C10G 1/02; C10B 49/04; C10B 49/16; C10B 53/06

See application file for complete search history.

(56) References Cited

U.S. PATENT DOCUMENTS

| | | | | |
|---|---|---|---|---|
| 4,260,369 A | | 4/1981 | Warshawsky | |
| 4,312,740 A | * | 1/1982 | Chiaramonte | C10G 1/02 201/12 |

(Continued)

FOREIGN PATENT DOCUMENTS

| | | |
|---|---|---|
| DE | 2537732 | 3/1997 |
| DE | 19921485 | 11/2000 |

*Primary Examiner* — Renee E Robinson

(74) *Attorney, Agent, or Firm* — Renner Kenner Greive Bobak Taylor & Weber

(57) ABSTRACT

The separation according to the invention of a material-laden hot gas stream substantially consists of the following method steps:

Figure 1:
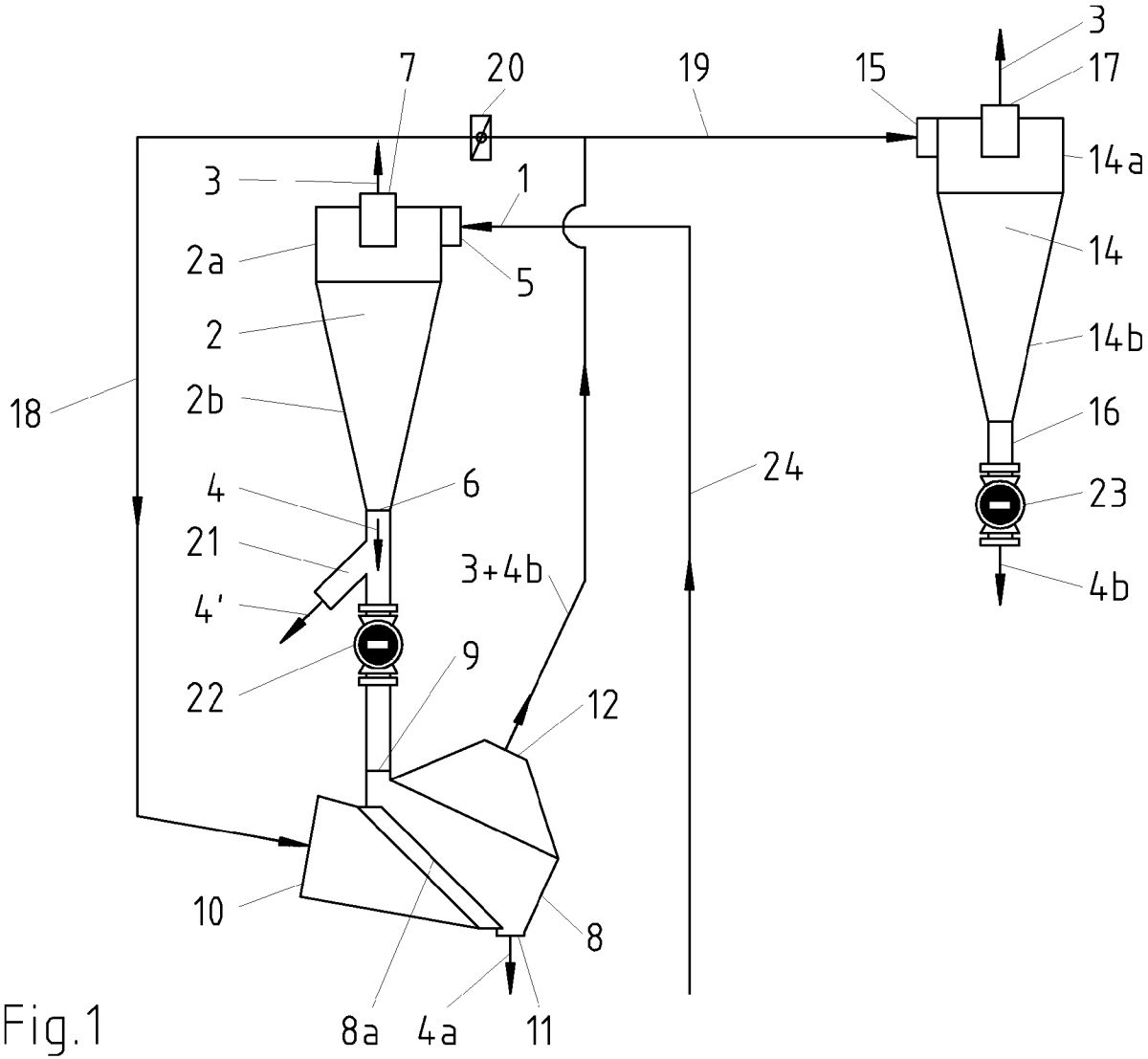

the material-laden hot gas stream is separated in a first separator into a gas stream and a material stream, wherein the material stream contains a coarser and a finer fraction, and the material stream is then classified in a classifier with at least a proportion of the gas stream, the coarser fraction of the material stream being discharged, while the finer fraction is carried away together with the gas stream separately from the coarser fraction.

6 Claims, 2 Drawing Sheets

(51) Int. Cl.
*B07B 9/02* (2006.01)
*C10G 1/04* (2006.01)

(56) References Cited

U.S. PATENT DOCUMENTS 4,377,466 A * 3/1983 Wallman ..... C10B 49/20
201/31
4,385,983 A * 5/1983 Rosenthal ..... C10G 1/02
208/411
4,389,950 A * 6/1983 Bertelsen ..... C10G 1/02
110/235
4,623,515 A 11/1986 Frei et al.

* cited by examiner

METHOD AND SYSTEM FOR SEPARATING A HOT GAS FLOW THAT IS CHARGED WITH MATERIAL AND METHOD FOR PROCESSING OIL SHALE MATERIAL

The invention relates to a method and an installation for separating a material-laden hot gas stream and to a method for processing oil shale material.

The phase separation of a material-laden hot gas stream in a temperature range of from 300° C. to 1000° C. proceeds for example in a suspension type heat exchanger, as is used in cement production for preheating the raw meal. In said heat exchanger, the material-laden hot gas stream is separated in centrifugal separators into a material stream and a gas stream.

DE 25 37 732 C3 describes a method for thermal processing of solid, bituminous substances, wherein a material-laden hot gas stream is separated in a first separator into a gas stream still laden with material particles and a material stream and the gas stream still laden with material particles is then fed to a further separator.

DE 199 21 485 discloses a method for disposing of chips containing light metals, wherein an air stream laden with chips is purified in a centrifugal separator and optionally a downstream particulate separator.

Often a material-laden hot gas stream contains a material in a broad grain size range of for example 0 to 50 mm, it possibly being desirable, for further processing of the material, for coarser and finer fractions of the material stream to be separate from one another. The requirements of such separation of coarse and fine fractions of the material stream cannot be adequately met by phase separation in a separator.

Using an air classifier, preferably a static classifier, a material-laden gas stream may be separated into two different streams, the one stream containing substantially just the gas stream with fine fractions and the other containing substantially just the coarse fractions from the material fed to the classifier. Such an air classifier consists substantially of a conical and cylindrical outer jacket, an inner cone with coarse material discharge, a vane ring with adjusting device and a submerged tube. The material-laden gas stream is initially passed upwards in the upwardly tapering annular space between the conical outer jacket and the inner cone into the cylindrical region, where the stream is passed through the vane ring. Consequently, the coarser fraction of the material stream slips over the inner cone to a coarse material outlet, while the finer fraction is carried away together with the gas via the submerged tube.

The above-described air classifier is however not suitable for hot gas stream temperatures in the range from 300° C. to 1000° C., since in particular the inner cone would come into contact both outside and inside with the hot material or the material-laden hot gas stream, and the vanes of the air guiding system would also come into contact therewith. Moreover, the material-laden hot gas stream would have the action of a hot sandblaster on the air guiding system, such that the latter would be subject to rapid wear.

The object of the invention is therefore that of providing a method and an installation, so as to allow separation of a relatively course material fraction of a material-laden hot gas stream even at temperatures of above 300° C., in particular above 600° C. A further object consists in improving the processing of oil shale material with such separation.

The method according to the invention for separating a material-laden hot gas stream substantially consists of the following method steps:

- the material-laden hot gas stream is separated in a first separator into a gas stream and a material stream, wherein the material stream contains a coarser and a finer fraction, and
- the material stream is then classified in a classifier, preferably a cross-flow classifier, with at least a proportion of the gas stream, the coarser fraction of the material stream being discharged, while the finer fraction is carried away together with the gas stream separately from the coarser fraction.

The installation according to the invention for separating a material-laden hot gas stream consists substantially of

- a first separator for separating the hot gas stream into a gas stream and a material stream containing a coarser and a finer fraction, with
  - an inlet for the material-laden hot gas stream,
  - an outlet for the material stream and
  - an outlet for the gas stream and
- a classifier connected to the first separator, with
  - a first inlet for infeed of the material stream,
  - a second inlet for infeed of the gas stream as a classifier gas stream,
  - a first outlet for the coarser fraction of the material stream and
  - a second outlet for the gas stream laden with the finer fraction.

As a result of the upstream phase separation, separation may proceed by way of the cross-flow or counter-flow method. These methods do not require any machine internals exposed to material-laden hot gas stream from two sides. Furthermore, by using the previously separated gas stream as a classifier stream, separation takes place in a closed process, such that the material stream does not leave the hot gas zone between entry into the first separator and exit from the classifier and thus the temperature drop of the material stream is minimised.

Further embodiments of the invention constitute the subject matter of the subclaims.

According to a further embodiment of the invention, the finer fraction of the material stream is fed together with the gas stream to a second separator, where the finer fraction is separated from the gas stream.

Moreover, the material-laden hot gas stream may exhibit a temperature of at least 350° C., preferably at least 600° C. The coarser and finer fractions of the material stream may additionally exhibit a grain size in the range from 0 to 50 mm, preferably up to 20 mm.

Separation and classification preferably proceed in such a way that the temperature drop in the material stream between entry into the first separator and exit from the classifier is minimised and is preferably less than 50° C. An attempt is additionally made to ensure that the temperature of the coarser fraction of the material stream is at least 300° C., preferably at least 600° C., on exit from the classifier.

In a preferred embodiment of the invention, the installation provides a second separator, the inlet of which is connected to the second outlet of the classifier and comprises a first outlet for the finer fraction of the material stream and a second outlet for the gas stream. The outlet for the gas stream from the first separator may be connected both with the second inlet of the classifier and with the inlet of the second separator, wherein a control element may be provided between the outlet for the gas stream from the first separator and the classifier and/or between the outlet for the gas stream from the first separator and the second separator for subdividing the gas stream flowing to the classifier and the second separator. The quantity of classifier air in the classifier may be adjusted purposefully with the assistance of the control element.

The two separators and the classifier are preferably designed for hot gas temperatures of 800° C. and above.

Furthermore, a control element may be provided for dividing the material stream between the first separator and the first inlet of the classifier, in order to discharge part of the material and/or in this way to control the masses of the classifier outlet streams.

The above-described method and the associated installation are used according to the invention in processing oil shale material, in particular in the Galoter method. The object of said method is to heat fresh material arriving in the retort using oil shale ash recirculated from the process and thereby to evaporate out the hydrocarbons contained therein. After leaving the retort, the oil shale ash has first of all to be heated back up to temperatures of in particular above 600° C., which may conveniently be achieved with the entrained flow method, which is favourable with regard to energy consumption. The problem then arises of feeding just the coarser ash constituents back to the retort. Separation of the coarser ash constituents from hot gas stream may proceed according to the invention using the above-described method and the associated installation.

Figure 2:
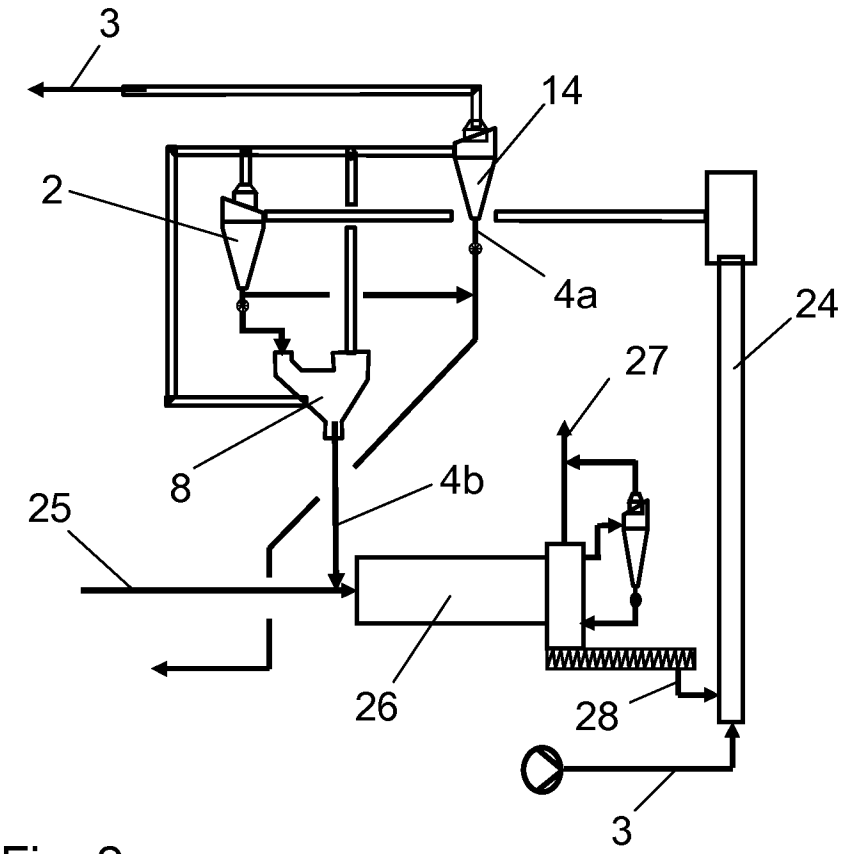

The invention is explained in greater detail with reference to the following description and drawings, in which:

FIG. 1 is a schematic representation of an installation according to the invention for separating a material-laden hot gas stream and FIG. 2 is a schematic representation of an installation for processing oil shale material comprising an installation according to FIG. 1.

The installation shown in FIG. 1 for separating a material-laden hot gas stream 1 consists substantially of

- a first separator 2 for separating the hot gas stream 1 into a gas stream 3 and a material stream 4 containing a coarser and a finer fraction, with
  - an inlet 5 for the material-laden hot gas stream 1,
  - an outlet 6 for the material stream 4 and
  - an outlet 7 for the gas stream 3,
- a classifier 8 connected to the first separator 2, with
  - a first inlet 9 for infeed of the material stream 4,
  - a second inlet 10 for infeed of the gas stream 3 as a classifier gas stream,
  - a first outlet 11 for the coarser fraction 4*a* of the material stream and
  - a second outlet 12 for the gas stream 3 laden with the finer fraction 4*b*,
- a second separator 14, the inlet 15 of which is connected with the second outlet 12 of the classifier 8 and comprises a first outlet 16 for the finer fraction 4*b* of the material stream 4 and a second outlet for the gas stream 3.

The outlet 7 for the gas stream 3 of the first separator 2 is connected both via a line 18 with the second inlet 10 of the classifier 8 and via a line 19 with the inlet 15 of the second separator 14. In order to be able to adjust subdivision of the gas stream 3 flowing to the classifier 8 or to the second separator 14, in the exemplary embodiment illustrated a control element 20 taking the form of a butterfly valve is provided in the line 19.

Moreover, a further control element 21 is provided for dividing the material stream 4 between the first separator 2 and the first inlet 9 of the classifier 8. This control element 21 may take the form, for example, of an adjustable material sorting gate and adjusts the volume of the material stream 4 arriving at the classifier 8. One fraction 4' may be discharged at this point and fed to further post-treatment.

The two separators 2, 14 preferably take the form of centrifugal separators, which each comprise a cylindrical upper part 2*a*, 14*a* and downwardly tapering conical lower part 2*b*, 14*b*. The inlets 5, 15 are each arranged tangentially on the cylindrical upper parts and the outlets 7, 17 for the gas stream 3 take the form of submerged tubes. The outlets 6, 16 for the material stream 4 or the finer fraction 4*b* are located at the lower end of the conical lower part 2*b*, 14*b*. The material-laden hot gas stream 1 or the gas stream 3 laden with the finer fraction 4*b* are thus introduced tangentially into the separator 2 or 14 respectively, wherein the material is carried away via the conical lower part and the gas stream via the submerged tube.

The classifier 8 conveniently takes the form of a static classifier and in particular of a cross-flow classifier and comprises an obliquely oriented aeration floor 8*a*, the material stream 4 being loaded from above onto the aeration floor and sliding thereon downwards towards the first outlet 11. At the same time, the material stream 4 is exposed to the gas stream 3 flowing as a classifier gas stream transversely through the aeration floor 8*a*. In the process, the finer fraction 4*b* of the material stream 4 is discharged with the gas stream 3 via the second outlet 12, while the coarser fraction 4*a* is discharged via the first outlet 11.

Cellular wheel sluices 22, 23 are preferably provided to regulate the volume of the material stream 4 to be fed to the classifier 8 and for gas-tight discharge of the finer fraction 4*b* from the installation.

The hot gas stream 1 may moreover be fed via a riser pipe 24 to the first separator 2. The riser pipe 24 may in this case serve to heat the material entrained in the gas stream to temperatures of 300° C. to 1000° C. The material in the hot gas stream may exhibit a grain size in the range from 0 to 50 mm, preferably up to 20 mm.

Depending on the setting of the volume of the gas stream 3 fed to the classifier 8 via the line 18 and the setting of the control element 21, the coarser fraction 4*a* may be adjusted purposefully with regard to quality and quantity. Separation in the first separator 2 and classification in the classifier 8 preferably proceed in such a way that the temperature drop in the material stream between entry into the first separator 2 and exit from the classifier 8 is minimised and is preferably less than 50° C. This is achieved in particular in that separation is a closed process and the material does not leave the hot zone. An attempt is additionally made to ensure that the temperature of the coarser fraction of the material stream is at least 300° C., preferably at least 600° C., on exit from the classifier.

The above-described method and the associated installation are used according to the invention in processing oil shale material, in particular in the Galoter method, which is described in greater detail below with reference to FIG. 2.

The same reference numerals denote the same components in FIGS. 1 and 2.

FIG. 2 shows an installation for processing oil shale material 25, which is fed to a retort 26, where hydrocarbons 27 are expelled thermally from the oil shale material 25 in the form of vapour. The oil shale ash 28 arising during this process is heated up outside the retort together with a gas stream 3 in a riser pipe 24, optionally with infeed of combustion fuel.

The resultant material-laden hot gas stream in the first separator 2, the classifier 8 and the second separator 14 is then separated in the manner described in FIG. 1 into the coarser fraction 4*b*, the finer fraction 4*a* and the gas stream 3, wherein the coarser fraction 4*b* is fed back to the retort, while the finer fraction is carried away, optionally together with a fraction of the material stream 4, and fed to a post-treatment, before the material is disposed of on a waste dump.

The invention claimed is:

1. A method for processing oil shale material comprising the steps of:

a. feeding the oil shale material to a retort, b. thermally expelling hydrocarbons from the oil shale material such that oil shale ash remains, c. heating the oil shale ash outside the retort together with a gas stream to form a material-laden hot gas stream, d. separating the material-laden hot gas stream in a separator, the material-laden hot gas stream being separated into a hot gas stream and a material stream, the material stream containing a coarser and a finer fraction mixed together, e. introducing the material stream and at least a portion of the hot gas stream to a classifier and classifying the material stream with the hot gas stream in the classifier, thereby separating the coarser fraction of the material stream from the finer fraction of the material stream, f. introducing the coarser fraction into the retort, g. carrying away the finer fraction together with the hot gas stream separately from the coarser fraction.

2. A method according to claim 1, characterised in that the finer fraction of the material stream is fed together with the hot gas stream to a second separator, where the finer fraction is separated from the gas stream.

3. A method according to claim 1, characterised in that the material-laden hot gas stream exhibits a temperature of at least 350° C.

4. A method according to claim 1, characterised in that the coarser and finer fractions of the material stream exhibit a grain size in the range from 50 mm or less.

5. A method according to claim 1, characterised in that the temperature drop of the material stream between entry into the separator and exit from the classifier is minimised.

6. A method according to claim 1, characterised in that the temperature of the coarser fraction of the material stream is at least 300° C. on exit from the classifier.

* * * * *